United States Patent [19]

Ravid

[11] 4,306,432

[45] Dec. 22, 1981

[54] DOOR LOCK

[76] Inventor: Eliezer Ravid, 15 Rockford Rd., Apt. 1007, Willowdale, Ontario, Canada

[21] Appl. No.: 133,665

[22] Filed: Mar. 25, 1980

[51] Int. Cl.[3] ..... E05B 63/14

[52] U.S. Cl. ..... 70/120; 292/34; 292/36

[58] Field of Search ..... 292/33, 34, 36, 37, 292/40, 165, 167; 70/108, 113, 118, 120

[56] References Cited

U.S. PATENT DOCUMENTS

| | | | |
|---|---|---|---|
| 3,991,595 | 11/1976 | Behry | 70/120 |
| 4,037,440 | 7/1977 | Shebtei | 70/108 |
| 4,237,710 | 12/1980 | Cardoze | 70/108 |

*Primary Examiner*—Robert L. Wolfe

*Attorney, Agent, or Firm*—George A. Rolston; William F. Frank

[57] ABSTRACT

A lock of the type having a plurality of locking bolts, having outer ends extending through openings in the door and inner ends located close to one another inside the door, and having a disc member, with arcuate slots and operating pins extending into the slots, and connecting with the inner ends of the bolts so that rotation of the disc in one direction will cause outward movement of the bolts, and rotation of the disc in the other direction will cause inward movement of the bolts, the lock having an operating lever swingably mounted adjacent the disc, and having one end swingable towards and away from it and connecting means between one end of the operating lever and a point on the disc spaced from its center of rotation, whereby swinging of the lever in one direction will be transmitted to the disc as a rotary movement in one direction, and swinging movement of the lever in the other direction will cause rotation of the disc in the other direction, and having means urging the lever in one direction, the lever being moveable against the force in the opposite direction, and having a locking barrel rotatably mounted adjacent to the lever at a point spaced from its pivot point, and, an abuttment on the locking means swingable into and out of engagement with the lever whereby to procure movement of same against the force in one direction and thus to procure rotary movement of the disc.

8 Claims, 1 Drawing Figure

DOOR LOCK

The invention relates to door locks, and in particular to locks having a plurality of locking bolts operated by a single mechanism.

Locks having a plurality of locking bolts, typically four such bolts, operated by a single lock mechanism, have been known for many years. In the majority of such locks the operation of the locking bolts is effected by means of a rotary disc, having a plurality usually four curved slots formed therein. Follower pins riding in the slots connect with the inner ends of the four locking bolts. When the disc is rotated in one direction the follower pins are forced outwardly relative to the disc, and rotation of the disc in the opposite direction will draw the pin and their assoicated locking bolts inwardly.

In many of these systems, the disc is provided with gear like teeth, either all around the disc or at least on a segment of the disc. A rotary operating gear or train of gears engages such teeth, and are themselves rotated by a suitable lock tumbler mechanism. In one particular example the lock tumbler mechanism is especially designed and made so as to incorporate a gear wheel arranged around the barrel of the tumblers so that when the lock barrel is rotated the gear rotates with it and drives the disc.

These systems are completely effective and practical in use and have produced very satisfactory results.

However, they are somewhat expensive to produce, and must be made to certain acceptable tolerances in order to function satisfactorily without jamming.

In addition, when it is desired to change the lock combination for example so that it can only be operated by a new key then it may in some such locks be necessary to remove not simply the lock barrel itself but the entire lock assembly together with the gear, and replace it with another one.

The general objective of the invention is to provide a multi-bolt disc operated lock of the type described, which is cheaper and simpler to manufacture, and in which the locking barrels themselves are more readily interchangeable.

With these objectives in mind, the invention comprises a lock of the type having a plurality of locking bolts, having inner ends and outer ends, the outer ends being adapted to extend through openings in the door for locking the door, and the inner ends being located close to one another, and there being a disc member, having generally arcuate slots formed therein, and operating pins extending into the slots, and connecting with the respective inner ends of the bolts, whereby rotation of the disc in one direction will cause outward movement of the bolts, and rotation of the disc in the other direction will cause inward movement of the bolts, the lock being characterized by an operating lever swingably mounted adjacent said disc, and having one end swingable towards and away therefrom, connecting means connecting between said one end of said operating lever and a point on said disc spaced from its centre of rotation, whereby swinging of said lever in one direction will be transmitted to said disc as a rotary movement thereof in one direction, and swinging movement of said lever in the other direction will cause rotation of said disc in the other direction, means urging said lever in one direction, said lever being moveable against said force in the opposite direction, locking barrel means rotatably mounted adjacent to said lever at a point spaced from its pivot point, and, abuttment means on said locking means swingable into and out of engagement with said lever whereby to procure movement of same against said force in one direction, whereby to procure said rotary movement of said disc member.

By means of the aforesaid lever action, it is possible to move the disc in a rotary manner without the use of gears and gear teeth interlocking with one another, and the manufacture and the assembly of the entire unit can thus be made less costly, without in anyway impairing its effectiveness in use.

In addition, the locking barrel can be made essentially separate from the disc and its operating mechanism so that it is much cheaper and easier to replace the locking barrels when necessary.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

As shown in the illustrations, the lock according to the invention comprises a back plate 10 and a front plate 12, the plate 12 being cut-away to reveal the interior. Clearly the plates 10 and 12 may simply be flat plates held together by suitable pins (not shown) or alternatively may be stampings, so as to provide side walls (not shown) if it is desired to form a completely closed in lock.

Figure 2:
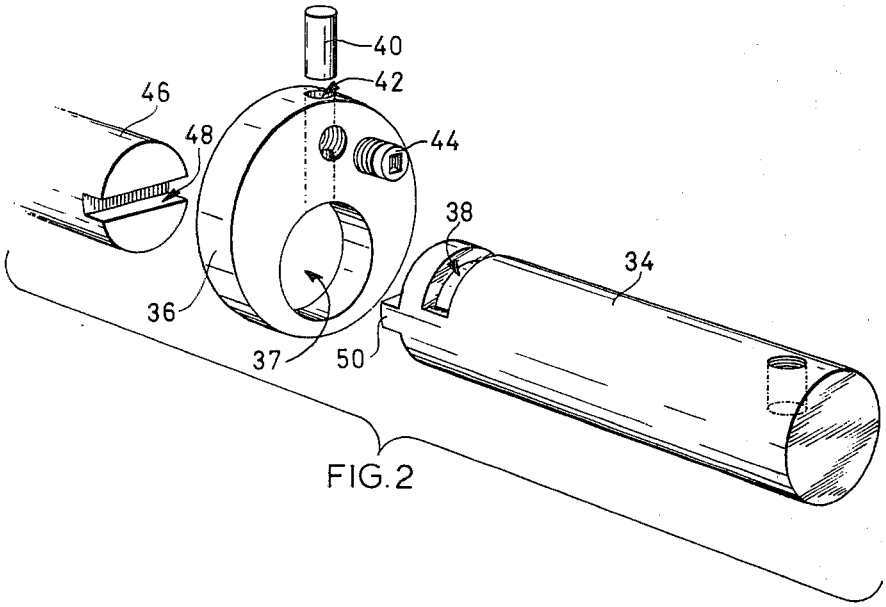
FIG. 2 is a side elevational view of the same mechanism from the opposite side, and, FIG. 3 is a section along the line 3—3 of FIG. 1.
Figure 3:
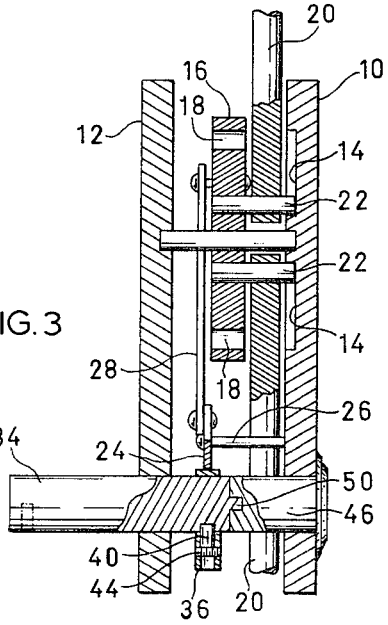

The back plate 10 is formed (see FIG. 2) with four radial slots 14, for purposes to be described below.

Pivotally mounted between the plates 10 and 12 is the operating disc 16, rotatable about its centre point on a suitable pivot pin, which is rotatably mounted between the plates 10 and 12 as shown.

Disc 16 is provided with four curved slots 18, arranged in a partially spiral manner. The slots 18 are equally spaced radially about the centre of the disc 16, and at their inner ends, are relatively close to the centre of the disc 16, and at their outer ends, they are located just inwardly of the circumference of the disc, with the curvature of the outer ends of the slots 18 being arranged to lie more or less upon the perimeter of a circle.

Other arrangements of curved slots 18 can be provided so that the inner and outer ends are essentially straight, with the curvature taking place only in the intermediate portion of the slots. However, the details of such discs 16 and slots 18 and the possible variations are well known in the art, and are shown in various earlier patent disclosures, and are accordingly not described in detail.

Four locking bolts 20 are provided, there being one such bolt 20 for each edge of the door. Theoretically there could be different numbers of such bolts 20 but in practice four is the most convenient number to provide the maximum security, with a minimum number of complications.

The bolts 20 are arranged in a radialy manner relative to the centre of rotation of the disc 16, and are shown located at right angles to one another.

They are of varying lengths so that they extend up to the four edges of the door, and may then be extended and retracted relative to such edges for locking and unlocking.

At their inner ends, which are located closely adjacent to one another they are provided with follower pins 22, which ride both in the curved slots 18 and also in the straight slots 14 in the back plate 10.

Thus when the disc 16 is rotated in one direction the interaction between the pins 22 the slots 18 and the slots 14 will be such that the rods are forced outwardly, and when the disc 16 is rotated in the reverse direction the rods will be drawn inwardly.

In this way a locking and unlocking action of the bolts 20 is provided.

In order to rotate the disc 16, or at least to provide the partial rotation required for this purpose, a lever mechanism is provided which comprises the operating lever 24 pivotally mounted on plate 10 at pivot point 26. The lever 24 has two ends **24*a* and 24*b* extending on opposite sides of the pivot 26. The end 24*a* is connected to a connecting rod 28, in a pivotal manner, which is in turn connected to disc 16** in a rotary manner.

The end **24*a* may also be connected to a biasing spring 30**.

The opposite end **24*b* of the lever is also connected to a biasing spring 32, both springs 30 and 32** providing a biasing in the same manner.

An operating shaft 34 is rotatably mounted in plate 12 in a suitable opening therein. Any suitable door knob or handle can be attached at the free end of shaft 34. An operating cam 36 has an opening 37 by it which it is rotatably mounted on shaft 34, for operation of lever 24. Shaft 34 is provided with a semi-annular groove 38, and cam 36 is provided with a drive pin 40, located in bore 42, and held by set screw 42. Pin 40 rides in groove 38 so as to provide a 180° free play between cam 36 and shaft 34.

A locking barrel 46 is mounted in plate 10, and comprises locking tumblers operated by a key in well known manner, the details of which are omitted for the sake of clarity.

Barrel 46 has a drive slot 48 at its inner end, engaging ridge 50 on the inner end of shaft 34.

Figure 1:
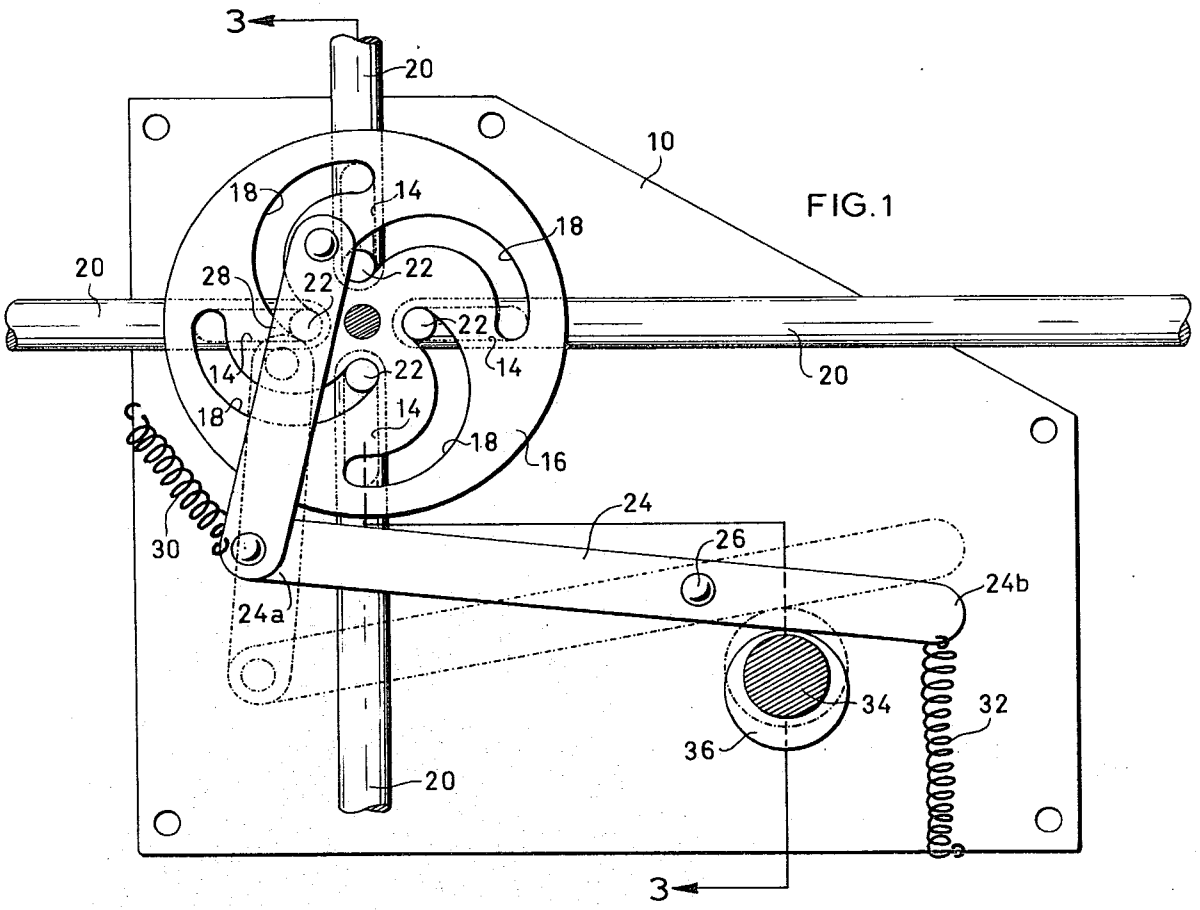
FIG. 1 is a side elevational view of the lock mechanism according to the invention, partially cut-away to reveal its interior.

In this way, operation of a key in barrel 46, through 360°, will rotate cam 36 through 180°. The cam 36 will thus swing into engagement with the lever portion 24, thereby raising it as shown in phantom in FIG. 1 and lowering portion **24*a***.

This will draw the connecting rod 28 downwardly thereby causing counterclockwise rotation of the disc 16.

Such rotation of disc 16 will force the rods 20 outwardly into their locking position.

It will also tension the two springs 30 and 32.

Rotation of the locking barrel 34 in the reverse direction will bring the cam 36 out of engagement with the lever portion **24*b*. At this point the springs 30 and 32 will thus bias the lever portion 24*a* upwardly once more thereby causing clockwise rotation of the disc 16 and withdrawing the locking bolts 20**.

It will thus be seen that by the use of the invention it is possible to rotate the disc 16 in either direction, without the use of gears and gear teeth. In addition, the construction of the lever 24 and connecting rod 28 is of extreme simplicity, and will involve no special problems of tolerances or unusual manufacturing techniques.

In addition, the construction of the shaft 34, locking barrel 46, and cam 36 is also much simpler than the gear type units available in the past so that the provision of replacement locking barrels becomes much simpler than in the past.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A lock of the type having a plurality of locking bolts, having inner ends and outer ends, the outer ends being adapted to extend through openings in the door for locking the door, and the inner ends being located close to one another, and there being a disc member, having generally arcuate slots formed therein, and operating pins extending into the slots and connecting with the respective inner ends of the bolts, whereby rotation of the disc in one direction will cause outward movement of the bolts, and rotation of the disc in the other direction will cause inward movement of the bolts, the lock being characterized by;

an operating lever swingably mounted adjacent said disc, and having one end swingable towards and away therefrom;

connecting means connecting between said one end of said operating lever and a point on said disc spaced from its centre of rotation, whereby swinging of said lever in one direction will be transmitted to said disc as a rotary movement thereof in one direction, and swinging movement of said lever in the other direction will cause rotation of said disc in the other direction;

means urging said lever in one direction, said lever being movable against said force in the opposite direction;

locking barrel means rotatably mounted adjacent to said lever at a point spaced from its pivot point, and, abutment means on said locking means swingable into and out of engagement with said lever whereby to procure movement of same against said force in one direction, whereby to procure said rotary movement of said disc member.

2. A lock as claimed in claim 1 including spring means connected with said lever urging same in said one direction, said lever being movable against said spring means in the opposite direction.

3. A lock as claimed in claim 2 including further spring means, one said spring means being connected to one end of said lever and said further spring means being connected to the other end of said lever, both of said spring means urging said lever in said one direction.

4. A lock as claimed in claim 1 including rotatable shaft means coupled to said locking barrel, and a cam member mounted on said shaft means, for forming said abutment means, and being rotatable relative to said lever whereby to procure operation as aforesaid.

5. A lock as claimed in claim 4 including lost motion coupling means coupling said shaft with said cam whereby a predetermined rotational movement of said shaft will not be communicated to said cam.

6. A lock as claimed in claim 5 including connection means for the attachment of any suitable handle means to said shaft.

7. A lock as claimed in claim 5 wherein said shaft is provided with a semi-annular groove, and whereby said cam incorporates a recess for receiving said shaft, and a drive member in said cam engaging said annular recess.

8. A lock as claimed in claim 7 including retaining means retaining said drive pin in position in said cam.

* * * * *